United States Patent [19]

Odenwalder et al.

[11] 4,046,574

[45] Sept. 6, 1977

[54] COLOR PHOTOGRAPHIC MATERIAL WITH HOMOPHTHALIMIDE THIOETHER DEVELOPMENT INHIBITOR

[75] Inventors: Heinrich Odenwalder, Cologne; Erwin Ranz; Walter Puschel, both of Leverkusen; Hans Vetter, Cologne, all of Germany

[73] Assignee: AGFA-Gevaert, Aktiengesellschaft, Leverkusen, Germany

[21] Appl. No.: 650,676

[22] Filed: Jan. 20, 1976

[30] Foreign Application Priority Data

Jan. 24, 1975 Germany ..... 2502892

[51] Int. Cl.[2] ..... G03C 1/10; G03C 1/40; G03C 1/48; G03C 7/00

[52] U.S. Cl. ..... 96/99; 96/3; 96/29 D; 96/56; 96/56.2; 96/74; 96/76 R; 96/77; 96/95; 96/100 R

[58] Field of Search ..... 96/76 R, 77, 74, 95, 96/99, 100, 29 D, 3, 56, 56.2

[56] References Cited

U.S. PATENT DOCUMENTS

| | | | |
|---|---|---|---|
| 3,028,238 | 4/1962 | Poschel et al. | 96/9 |
| 3,227,554 | 1/1966 | Barr et al. | 96/95 |
| 3,580,722 | 5/1971 | Sakamoto et al. | 96/100 |
| 3,632,345 | 1/1972 | Marx et al. | 96/95 |
| 3,647,452 | 3/1972 | Hendess et al. | 96/55 |
| 3,928,041 | 12/1975 | Fujiwhara et al. | 96/3 |
| 3,932,185 | 1/1976 | Matsuura | 96/74 |
| 3,938,996 | 2/1976 | Fujiwhara et al. | 96/95 |

*Primary Examiner*—David Klein
*Assistant Examiner*—Richard L. Schilling
*Attorney, Agent, or Firm*—Connolly and Hutz

[57] ABSTRACT

A color photographic material having a silver halide emulsion layer and containing a thioether compound which is reactable on chromogenic development thereby releasing a diffusible substance which inhibits the development of the silver halide.

The thioether compound is a homophthalimide containing a removable mercapto group containing moiety in the 4-position and its nitrogen in the 2-position atom being a tertiary nitrogen.

6 Claims, No Drawings

COLOR PHOTOGRAPHIC MATERIAL WITH HOMOPHTHALIMIDE THIOETHER DEVELOPMENT INHIBITOR

This invention relates to a colour photographic material containing compounds which react with oxidation products of colour developer substances to liberate development inhibiting substances.

It is known that compounds which react with colour developer oxidation products to liberate development inhibitors may be incorporated in colour photographic materials. Compounds of this kind include, for example, the so-called DIR couplers (DIR = development inhibitor releasing) which have been described in U.S. Pat. No. 3,227,554 or the so-called DIR compounds described in U.S. Pat. No. 3,632,345.

The aforesaid DIR couplers and DIR compounds contain a thioether substituent in the coupling position, and when the colour coupling reaction takes place this substituent is split off as a diffusible mercapto compound which has development inhibiting properties and which is thereby capable of influencing the further development of the silver halide. The properties of the photographic materials are improved in numerous respects by using such DIR couplers. By using such couplers it is possible to control the graininess, sharpness and gradation and thereby achieve a substantial improvement in the colour reproduction as a whole. In this connection, reference may be made to the article in "Photographic Science Engineering" 13, 74 (1969) entitled "Development — Inhibitor - Releasing Couplers in Photography".

The known DIR couplers inevitably release a dye together with the development inhibitor whereas the known DIR compounds such as those described in the above mentioned U.S. Pat. No. 3,632,345 or those described in German Offenlegungsschriften Nos. 2,359,295, 2,015,814 2,405,442 and 2,015,867 do not give rise to colored compounds in their reaction with oxidized color developers.

It has been found, however, that the known DIR compounds are either too unstable or insufficiently reactive under certain processing conditions. If they are too unstable, the development inhibitor is not released imagewise and consequently there is a general regression in sensitivity. On the other hand, if they are insufficiently reactive the inhibitor is released too slowly and is therefore unable to influence the process of development to a sufficient extent.

The known DIR couplers and DIR compounds are generally not sufficiently reactive to influence the gradation, graininess, sharpness and inter-image effects in the desired manner even when they are sufficiently stable in the photographic layers to release the development inhibitor imagewise.

It is therefore one object of the present invention to provide new development inhibitor releasing thioether compounds which, when reacted with color developer oxidation products, release a mercapto group containing development inhibiting moiety. The development inhibitor compounds in the following called DIR compounds should be sufficiently reactive in the photographic material so that they provide in particular for a high edge effect for straightening out of the gradation curve and for producing the desired interimage effect. They should also be sufficently stable, and, not least important, these DIR compounds should also be easily prepared.

This and other objects of the present invention are solved very satisfactorily by means of homophthalimide DIR compounds which have a removable mercapto group in the 4-position.

It is therefore a further object of the present invention to provide a color photographic material which contains a DIR compound as defined above, preferably one which is nondiffusible. The DIR compound is contained in at least one silver halide emulsion layer or in a light-insensitive layer of binder associated therewith. During the chromogenic processing of the exposed photographic material the DIR compound reacts with the oxidation product of a color developer substance containing a primary aromatic amino group. a diffusible mercapto group containing moiety thereby splits off from the DIR compound which inhibits the development of the silver halide.

The material of the invention contains as DIR compound a homophthalimide compound containing a releasable group in the 4-position which can be split off on development by forming a mercaptan which has development inhibiting properties. The homophthalimide compound is moreover substituted at its nitrogen atom by any carbon atoms or nitrogen atoms of photographically inert groups which do not substantially interfere with the

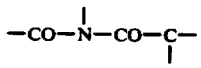

mercapto group of the. homophthalimide DIR compound. The nitrogen atom is characterized by being a tertiary nitrogen. It can therefore be substituted with a carbon atom of any alkyl, aryl or heterocyclic group or a nitrogen atom of a heterocyclic group or an acylamino group. The compounds to be used according to the invention can be named also as 1,3-(2H, 4H)-isoquinoline-dione compounds which are substituted by the mercapto group containing moiety in its 4-position.

Particularly suitable compounds used according to the invention are represented by the following formula:

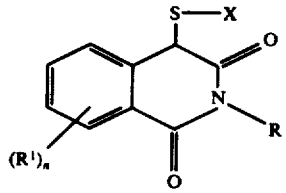

wherein

X denotes an optionally substituted group known in the art for development inhibiting mercapto groups. Examples are an aliphatic group, an aromatic group or in particular a heterocyclic group which, when split off with the sulphur atom of the thioether bridge, forms a diffusible mercapto compound which inhibits the development of silver halide;

R denotes an optionally substituted alkyl, aryl or heterocyclic group, any of which may be substituted, or an acylamino group which may be derivable from aliphatic or aromatic carboxylic or sulphonic acids;

$R^1$ denotes a short chain alkyl group preferably having up to 5 carbon atoms such as methyl or isopropyl, a short chain alkoxy group such as methoxy or ethoxy, a sulphamyl, nitro, amino or acylamino group, a halogen such as chlorine, or preferably hydrogen;

*n* represents an integer of from 1 to 3.

Examples of aliphatic groups represented by X include alkyl groups having from 1 to 10 C-atoms which may be substituted by carboxyl and/or amion groups, such as $-CH_2-COOH$ and $$-CH_2-\underset{\underset{COOH}{|}}{CH}-NH_2.$$

Examples of aromatic groups represented by X include phenyl or naphthyl groups which may be substituted, such as phenyl itself, carboxyphenyl or nitrophenyl.

Examples of heterocyclic groups represented by X include the following:

5-membered or 6-membered heteroaromatic groups containing at least one nitrogen atom, such as tetrazolyl, e.g. 1-phenyltetrazolyl, 1-nitrophenyltetrazolyl, or 1-naphthyltetrazolyl; triazolyl, e.g. 1-phenyl-1,2,4-triazolyl; thiadiazolyl, e.g. 2-phenylamino-1,3,4-thiadiazolyl;. oxadiazolyl; thiazolyl, including benzothiazolyl and naphthothiazolyl; oxazolyl, including benzoxazolyl and naphthoxazolyl, e.g. 7-sulphonaphtho [2,3-d]-oxazolyl; pyrimidyl, e.g. 4-methyl-6-aminopyrimidyl or 4-methyl-6-hydroxypyrimidyl; or triazinyl, e.g. thiadiazolotriazinyl.

It is preferred to use compounds in which R contains a photographically inert group which renders the compounds diffusion resistant.

Groups may be regarded as conferring diffusion resistance if they enable the compounds according to the invention to be incorporated in a diffusion-fast form in the hydrophilic colloids conventionally used in photographic materials. Groups which are particularly suitable for this purpose are organic groups which may generally contain straight-chain or branched-chain aliphatic groups and optionally also isocyclic or heterocyclic aromatic groups. The aliphatic portion of these groups generally contains from 8 to 20 C—atoms. These groups are attached to the remainder of the molecule either directly or indirectly, for example through one of the following groups: —CONH—, $-SO_2NH-$, —CO—, $-SO_2-$, —O—, —S— or —NR'— in which R' denotes hydrogen or alkyl.

The diffusion conferring group may in addition contain water-solubilising groups, e.g. sulpho groups or carboxyl groups, which may also be present in an anionic form. Since the diffusion properties depend on the total size of the molecule of the compound used, it is sufficient in certain cases, for example if the total molecule is sufficiently large, to use one or more shorter chain groups such as tert.-butyl, cyclopentyl or isoamyl groups for conferring diffusion resistance.

Particularly suitable compounds of the above formula are those wherein R denotes an alkyl group having from 8 to 20 C-atoms, or a phenyl group optionally substituted with one or more alkyl, alkoxy, cycloalkyl or acyl groups which may be derived from monoester of carbonic acid or from aliphatic or aromatic carboxylic or sulphonic acids such as benzoyl, sulphonyl, alkylaminosulphonyl, alkoxycarbonyl, or alkylaminocarbonyl groups.

Compounds of the above formula wherein X denotes a 1-phenyltetrazolyl group have proved to be particularly useful.

Examples of compounds which may be used according to the invention are given below:

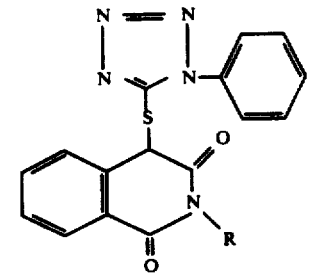

| | R | m.p. |
|---|---|---|
| 1) | $-(CH_2)_{15}-CH_3$ | 54 - 55.5° C |
| 2) | $-(CH_2)_{17}-CH_3$ | 61.5 - 63° C |
| 3) | 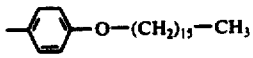 | 96 - 97.5° C |
| 4) | 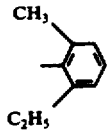 | 139.5° C (decomp.) |
| 5) | 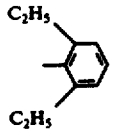 | 97° C (decomp.) |
| 6) | 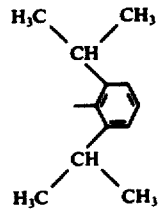 | 170 - 171° C (decomp.) |
| 7) | 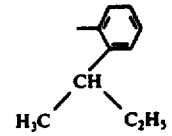 | 145° C (decomp.) |
| 8) | 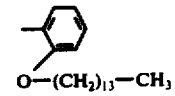 | 89 - 90.5° C |
| 9) | 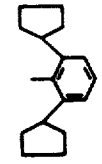 | 159° C (decomp.) |
| 10) | 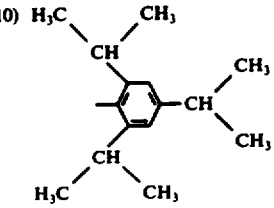 | 153° C (decomp.) |

-continued

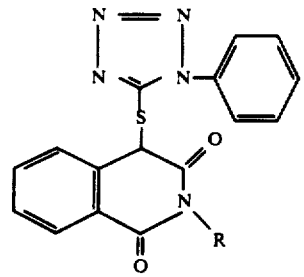

| R | m.p. |
|---|---|
| 11) 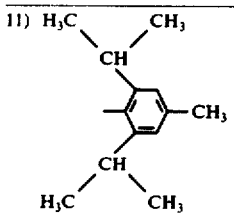 | 160° C (decomp.) |
| 12) 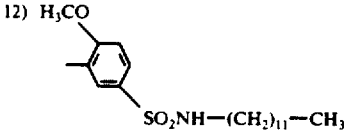 | 98.5 - 100° C |
| 13) 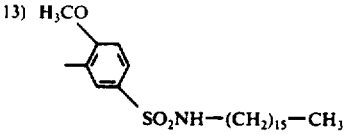 | 103 - 105° C |
| 14) 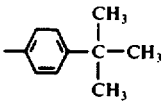 | 115° (decomp.) |
| 15) 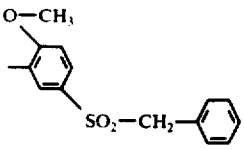 | 180.5° C |

The N-substituted homophthalimides required as starting materials may be prepared by the method given by Gabriel in Chem. Ber. 20, 1204 of reacting orthocarboxyphenyl-acetic acid with anilines.

Another method of preparation has been described in Chem. Ber. 40, 241 and in Angew. Chem. 86, 349 (1974).

Homophthalimide compounds in which the benzene ring is substituted by amino groups or by acylamino groups which are derivable from aliphatic or aromatic sulphonic or carboxylic acids are obtained by catalytic hydrogenation of the corresponding nitro homophthalimides to form the amino homophthalimides, which in turn can be acylated or known methods.

The introduction of the mercapto group in the 4-position of the homophthalimide is achieved by reacting the homophthalimide with the disulphide of the corresponding mercapto compound in ethanol. Alternatively the inhibitor group may be introduced by combining a solution of the appropriately substituted homophthalimide in an inert solvent (such as chloroform or carbon tetrachloride) with a solution of the sulphenyl chloride or sulphenyl bromide of the inhibitor in an inert solvent such as chloroform or carbon tetrachloride.

Preparation of Compound 1

4.5 g of homophthalic acid and 6.25 g of hexadecylamine are heated to 200° C for one hour. When the reaction mixture is cold, it is stirred up with 200 ml of methanol and filtered, and the residue is washed with methanol.

Yield: 6.8 g.

M.p.: 64°-66° C 7.7 g of the 2-hexadecylhomophthalimide obtained are introduced into a solution of 3.5 g of 1-phenyl-5-mercapto-tetrazole disulphide, 0.51 ml of bromine and 60 ml of chloroform and heated under reflux for 3 hours. The solvent is subsequently distilled off under vacuum and the residue is stirred up with methanol. 8 g of compound 1 with a melting point of 54°-55.5° C could be obtained after recrystallisation from ethanol.

Preparation of compound 8

10.8 g of homophthalic acid and 18.3 g of 2-tetradecyloxianiline are reacted as described above to produce 22.5 g of 2-(2-tetradecyloxiphenyl)-homophthalimide melting at 53°-54.5° C.

4.5 g of the compound obtained in this way were dissolved in 30 ml of chloroform, and a solution of 2.1 g of 1-phenyl-5-tetrazolyl-sulphenyl chloride in 30 ml of chloroform was added.

The resulting mixture was heated under reflux for ½ hour and the solvent was then distilled off under vacuum and the oily residue stirred up with n-propanol. The precipitate was then suction-filtered and washed with methanol.

Yield: 4.6 g.

M.p.: 89°-90.5° C.

The compounds according to the present invention are comparable with the known DIR couplers and DIR compounds in that they also represent non-diffusible thioether compounds which react with colour developer oxidation products to release a diffusible mercaptan which inhibits the development of silver halide. According to U.S. Pat. No. 3,148,062, DIR couplers are subdivided into those in which the removable group already has an inhibitory action before coupling and those in which the inhibitory action comes into play only when a radical is split off at the coupling position. In this second type of couplers, the inhibitor is said to be non-preformed. According to this terminology, the compounds according to the invention are also non-diffusible compounds which react with colour developer oxidation products to release a diffusible, nonpreformed development inhibitor.

Compared with the known DIR couplers and DIR compounds, the compounds according to the invention are distinguished by their higher reactivity. This has the advantage that, when they are used in photographic materials, they provide better control of the gradation and graininess as well as improving the sharpness, the edge effects and the inter-image effects.

The compounds which may be used according to the invention are characterised by the position of the mercapto group adjacent to the carbonyl group and to the phenyl ring of the basic homophthalimide molecule and by the additional reaction accelerating influence of the other ring members of the basic phthalimide molecule, such as the second carbonyl group in the 1-position and the substituted nitrogen atom in the 2-position of the homophthalimide molecule. It is surprisingly found that analogous compounds which do not have the structural features of the compounds according to the invention are substantially inferior in their reactivity in the manner indicated. For example, 4-hydroxy-1'-alkylcarbostyril compounds which are substituted by a mercapto group in the 3-position react much more slowly than the compounds according to the invention. Similarly, 4-piperidone-like compounds described in German Offenlegungsschrift No. 2,405,442, such as 4-piperidones which contain a mercapto compound in the 3-position, are less reactive than the compounds according to the invention.

The compounds according to the invention are therefore suitable in particular for obtaining high edge effects and inter-image effects.

Moreover, the DIR compounds according to the invention are very easily obtainable and in this respect superior in particular to the DIR couplers of U.S. Pat. No. 3,632,345.

The DIR compounds according to the invention are particularly useful in colour photographic multilayered materials in which the silver halide is developed by conventional colour developers after imagewise exposure, for example by the usual aromatic compounds of the p-phenylene diamine series which contain at least one primary amino group.

The following are examples of suitable colour developers:

N,N-dimethyl-p-phenylenediamine,
N,N-diethyl-p-phenylenediamine,
monomethyl-p-phenylenediamine,
2-amino-5-diethylaminotoluene,
N-butyl-N-ω-sulphobutyl-p-phenylenediamine,
2-amino-5-(N-ethyl-N-β-methanesulphonamidoethylamino )-toluene,
N-ethyl-N-β-hydroxyethyl-p-phenylenediamine,
N,N-bis-(β-hydroxyethyl )-p-phenylenediamine,
2-amino-5-(N-ethyl-N-β-hydroxyethylamino )-toluene, and the like.

Other suitable colour developers have been described, for example, in J.Amer.Chem.Soc. 73, 3100 (1951).

The developer compounds are normally introduced into an alkaline developer bath in which the colour photographic material is treated after imagewise exposure but they may also be incorporated in one or more layers of the photographic material. In the latter case, the developer compounds may contain groups which confer diffusion resistance on them and they may be situated in a layer which also contains a diffusion resistant colour coupler or a diffusion resistant colour producing compound, for example as described in U.S. Pat. No. 3,705,035.

In that case, all that is necessary for development is an alkaline activator solution containing an auxiliary developer such as phenidone. The oxidation product of the colour developer produced in the development process reacts with the non-diffusible colour coupler to form a non-diffusible image dye or it reacts with the non-diffusible colour producing compound to form an imagewise distribution of diffusible dyes which can be transferred to an image receptor layer. At the same time, the oxidation product of the colour developer reacts with the non-diffusible DIR compounds according to the invention which are also present to liberate diffusible inhibitor molecules, while a substantially unstable blue to cyan dye is formed from the remainder of the molecule of the DIR compound.

The colour photographic multilayered material according to the invention contains a compound preferably of the formula (I) in at least one of its layers. This DIR compound may be incorporated in a light-sensitive silver halide emulsion layer or it may be incorporated in an associated hydrophilic layer of binder which need not itself be light sensitive. The term "associated" is used in this context to refer to a layer which has a spatial relationship to the light-sensitive silver halide emulsion layer such that substantial quantities of colour developer oxidation products diffuse into it from the light sensitive silver halide emulsion layer in the process of development.

The concentration at which the DIR compound according to the invention is contained in the layer may vary within wide limits, for example between $0.1 \cdot 10^{-3}$ and $40 \cdot 10^{-3}$ mol/kg of silver halide emulsion and between $0.1 \cdot 10^{-3}$ and $10 \cdot 10^{-3}$ mol per gram of binder in the associated layers of binder. The concentration used depends on the particular purpose for which the compound is required, the particular silver halide emulsion used and whether the DIR compound is contained in a silver halide emulsion layer or in a light-insensitive layer of binder. The upper limit of concentration can advantageously be kept lower than the concentrations in which colour couplers are used in photographic layers since the compounds according to the invention produce excellent effects even when employed in small concentrations.

The compounds according to the invention are preferably used in the magenta or cyan layer of colour photographic multi-layered materials or in a hydrophilic layer adjacent to the said layer because high inter-image effects are preferred in these layers.

The inhibitory effect of the compounds used according to the invention may develop both in the layer which contains the compound according to the invention, provided this layer contains developable silver halide, and in adjacent silver halide emulsion layers into which the released inhibitor is capable of diffusing. In this way, the compounds according to the invention can be used for controlling the development in each of the individual light-sensitive silver halide emulsion layers in a variety of ways, and it is also possible to influence the development of a silver halide emulsion by the results of image development in another layer of utilising the vicinal effects which can be achieved with the compounds according to the invention, so that the graininess, sharpness and colour reproduction are improved overall.

The light-sensitive silver halide emulsion layers of the photographic material according to the invention have differing spectral sensitivities and each layer has associated with at least one non-diffusible compound to produce an image dye in a colour which is generally complementary to the spectral sensitivity. These compounds are conventional colour couplers which are generally incorporated in the silver halide layers. The red-sensitive layer, for example, contains a non-diffusible colour coupler for producing the cyan partial image, generally a coupler of the phenol or α-naphthol series. The green-sensitive layer contains at least one non-diffusible colour coupler for producing the magenta partial image, usually a colour coupler of the 5-pyrazolone or the indazolone series. The blue-sensitive layer unit contains at least one non-diffusible colour coupler for producing the yellow partial image, generally a colour coupler with an open chain keto methylene group. Numerous colour couplers of this kind are already known and have been described in numerous patent specifications. Reference may be made, for example, to the publications by W. Pelz entitled "Farbkuppler" in "Mitteilungen aus den Forschungslaboratorien der Agfa, Leverkusen/Munchen", Volume III (1961), and the publication by K. Venkataraman in "The Chemistry of Synthetic Dyes", Volume 4, 341 - 387, Academic Press 1971.

The non-diffusible colour couplers may contain a removable substituent in the coupling position so that they only require two equivalents of silver halide for producing the colour, in contrast to the usual 4-equivalent couplers. The colour couplers are generally themselves colourless but if the removable substituent contains a chromophoric group, as in the known masking couplers, the colour couplers generally have a colour which is suitable for masking unwanted side densities of the image dye by conventional masking techniques. The image dyes produced from the colour couplers are generally diffusion-resistant.

In some cases, however, the image dyes may first be produced in a diffusible form by development and only subsequently fixed after transfer to an image receptor layer. This method is known from various dye diffusion transfer processes, for example those described in U.S. Patent Specifications Nos. 3,227,550 and 3,628,952 and German Pat. Specification No. 1,772,929. In these cases, the light-sensitive silver halide emulsions are associated with either colourless or coloured non-diffusible colour producing compounds which release diffusible dyes in an imagewise distribution when developed. These colour producing compounds are incorporated either in the silver halide emulsion layer or in an associated hydrophilic binder layer which may, for example, contain development nuclei and if desired also a silver halide which is developable without exposure.

Non-diffusible colour couplers or non-diffusible colour producing compounds used in combination with conventional silver halide emulsions normally give rise to negative colour images but the DIR compounds according to the invention, like the DIR couplers, may also advantageously be used in reversal processes to produce positive images. These positive images may be obtained either by conventional reversal processes in which the photographic material is first subjected to a process of black-and-white development after imagewise exposure and then colour developed after a diffuse second exposure, or they may be obtained by a reversal process in which the imagewise information in the photographic material is reversed by the presence of the DIR compounds according to the invention. This can be achieved, for example, by arranging an ordinary silver halide emulsion layer containing a DIR compound next to a spontaneously developable silver halide emulsion layer, i.e. one which is developable without exposure, which contains a colour coupler or colour producing compound. It is obvious that the DIR couplers or DIR compounds used for such a procedure must release the inhibitor very rapidly so that the inhibitor will effect imagewise inhibition of development in the spontaneously developable layer.

The non-diffusible colour couplers and colour producing compounds as well as the non-diffusible development inhibitor releasing compounds used according to the invention are added to the light-sensitive silver halide emulsions or other casting solutions by the usual, known methods. If these compounds are water-soluble or alkali-soluble, they may be added to the emulsions in the form of aqueous solutions, if desired with the addition of water-miscible organic solvents such as ethanol, acetone or dimethylformamide. If, on the other hand, the non-diffusible colour couplers, colour producing compounds and development inhibitor releasing compounds are insoluble in water or alkalis, they may be emulsified in known manner, for example by directly mixing a solution of the compound in a low boiling organic solvent with the silver halide emulsion or by first mixing the compound with an aqueous gelatine solution, and removing the organic solvent in the usual manner, and the resulting gelatine emulsion of the given compound may be finally mixed with the silver halide emulsion. If desired, emulsification of such hydrophobic compounds may be assisted by the addition of so-called coupler solvents or oil formers, which are generally higher boiling organic compounds in which the non-diffusible colour couplers and development inhibitor releasing compounds which are required to be emulsified in the silver halide emulsions become enclosed in the form of oily droplets (see, for example, U.S. Patent Specifications Nos. 2,322,027, 2,533,514, 3,689,271, 3,764,336 and 3,765,897). If the compounds according to the invention are emulsified in the layers with the aid of such oil formers, less powerful diffusion conferring groups may be used in the compounds according to the invention since in these cases even shorter alkyl groups such as t-butyl or isoamyl groups are sufficient to prevent diffusion of the compounds according to the invention in the layers of the photographic material.

The usual silver halide emulsions are suitable for the present invention. The silver halides contained in them may be silver chloride, silver bromide or mixtures thereof, if desired with a small silver iodide content of up to 20 mol %. The emulsions may be ordinary negative emulsions or direct-positive emulsions, for example those which have a high sensitivity in the interior of the silver halide grains, e.g. the emulsions described in U.S. Pat. No. 2,592,250.

The binder used for the photographic layers is preferably gelatine but it may be partly or completely replaced by other natural or synthetic binders. Suitable natural binders include e.g. alginic acid and its derivatives such as its salts, esters or amides, cellulose derivatives such as carboxymethylcellulose, alkylcelluloses such as hydroxyethylcellulose, starch or its derivatives such as its ethers or esters, or carrageenates. Suitable synthetic binders are, for example, polyvinyl alcohol, partially saponified polyvinyl acetate and polyvinylpyrrolidone.

The emulsions may also be chemically sensitised, e.g. by the addition of sulphur compounds such as allylisothiocyanate, allythiourea, sodium thiosulphate and the like, at the chemical ripening stage. Reducing agents may also be used as chemical sensitisers, e.g. the tin compounds described in Belgian Patent Specification Nos. 493,464 or 568,687 or polyamines such as diethylene triamine or aminomethanesulphinic acid derivatives, e.g. according to Belgian Patent Specification No. 547,323.

Noble metals such as gold, platinum, palladium, iridium, ruthenium or rhodium and compounds of these metals are also suitable chemical sensitisers. This method of chemical sensitisation has been described in the article by R. Koslowsky, Z. Wiss, Phot. 46, 65 - 72 (1951).

The emulsions may also be sensitised with polyalkylene oxide derivatives, e.g. with a polyethylene oxide which has a molecular weight of between 1000 and 20,000 or with condensation products of alkylene oxides and aliphatic alcohols, glycols, cyclic dehydration products or hexitols, or with alkyl-substituted phenols, aliphatic carboxylic acids, aliphatic amines, aliphatic diamines and amides. The condensation products have a molecular weight of at least 700 and preferably more than 1000. These sensitisers may, of course, also be combined to produce special effects, as described in Belgian Patent Specification No. 537,278 and in British Patent Specification No. 727,982.

The emulsions may also be spectrally sensitised, e.g. with the usual monomethine or polymethine dyes such as acid or basic cyanines, hemicyanines, streptocyanines, merocyanines, oxonoles, hemioxonoles, styryl dyes or others, including also trinuclear or higher nuclear methine dyes, for example rhodocyanines or neocyanines. Sensitisers of this kind have been described, for example, in the work by F.M. Hamer entitled "The Cyanine Dyes and Related Compounds" (1964), Interscience Publishers John Wiley and Sons.

The emulsions may also contain the usual stabilisers, for example homopolar or salt compounds of mercury which contain aromatic or heterocyclic rings, such as mercapto triazoles, or the simple mercury salts, sulphonium mercury double salts and other mercury compounds. Azaindenes are also suitable stabilisers, particularly tetra- or penta- azaindenes and especially those which are substituted with hydroxyl or amino groups. Compounds of this kind have been described in the article by Birr, Z. Wiss, Phot. 47, 2 - 58 (1952). Other suitable stabilisers include heterocyclic mercapto compounds, e.g. phenylmercaptotetrazole, quanternary benzothiazole derivatives or benzotriazole.

The emulsions may be hardened in the usual manner, for example with formaldehyde or halogenated aldehydes which contain a carboxyl group, such as mucobromic acid, diketones, methanesulphonic acid esters or dialdehydes.

The photographic layers may also be hardened with epoxide hardeners, heterocyclic ethyleneimine hardeners or acryloyl hardeners. Examples of such hardeners have been described, for example, in German Offenlegungsschrift No. 2,263,602 and in British Patent Specification No. 1,266,655. The layers may also be hardened by the process according to German Offenlegungsschrift No. 2,218,009 to produce colour photographic materials which are suitable for high temperature processing.

The photographic layers or colour photographic multilayered materials may also be hardened with hardeners of the diazine, triazine or 1,2-dihydroquinoline series as described in British Patent Specifications Nos. 1,193,290, 1,251,091, 1,306,544 and 1,266,655, in French Patent Specification No. 7102716 or in German Patent Application P 23 32 317.3. Examples of such hardeners include diazine derivatives which contain alkyl or aryl sulphonyl groups, derivatives of hydrogenated diazines or tirazines, such as 1,3,5-hexahydrotriazine, fluoro-substituted diazine derivatives, e.g. fluoropyrimidines, and esters of 2-substituted 1,2-dihydroquinoline- or 1,2-dihydroisoquinoline-N-carboxylic acids. Vinyl sulphonic acid hardeners and carbodiimide or carbamoyl hardeners such as those described e.g. in German Offenlegungsschriften Nos. 2,263,602, 2,225,230 and 1,808,685, in French Patent Specification No. 1,491,807, in German Patent Specification No. 872,153 and in DDR Patent Specification No. 7218 may also be used. Other useful hardeners have been described, for example, in British Patent Specification No. 1,268,550.

The materials according to the invention may be, for example, positive, negative or reversal materials mounted on the usual layer supports used in known manner for the preparation of photographic materials. Suitable supports include e.g. foils of cellulose nitrate, cellulose acetate such as cellulose triacetate, polystyrene, polyesters such as polyethylene terephthalate, polyolefines such as polyethylene or polypropylene, baryta paper supports or polyolefine laminated paper supports such as polyethylene laminated paper, as well as glass.

EXAMPLES

The DIR compounds are preferably used in multilayered arrangements of the kind used, for example, for the preparation of light-sensitive negative or positive colour photographic materials.

The effectiveness of the DIR compounds according to the invention is illustrated below by the example of a typical layer arrangement or partial layer arrangement for colour negative materials. Light-sensitive photographic material:

Arrangement of layers

Support: Substrated cellulose triacetate support a. Intermediate layer of gelatine (1μ);
b. Cyan layer consisting of an emulsion which has been sensitised to the red spectral region and contains a colour coupler for cyan (silver application: 4 g Ag/m²);
c. Intermediate gelatine layer (1μ)
d. Purple layer consisting of an emulsion which has been sensitised to the green spectral region and contains a colour coupler fo magenta (silver application: 3.5 g Ag/m²);
e. Intermediate gelatine layer (1μ);
f. Yellow filter layer (2μ);
g. Yellow layer consisting of an emulsion which has been sensitised to the blue spectral region and contains a colour coupler for yellow (silver application 1.5 g Ag/m²); and
h. Protective gelatine layer (1μ).

The material is hardened in the usual manner, e.g. using trisacryloyl-hexahydrotriazine. The individual partial layers which are sensitive to red (*b*), green (*d*) and blue (*g*) are prepared by casting the following solutions;

*b.*

1 kg of a red-sensitised silver halide emulsion (100 g Ag/kg emulsion) in which 98 mol % of the silver halide consists of silver bromide and 2 mol % of silver iodide, 50 ml of a 1% solution of 1,3,3a,7-tetraaza-4-hydroxyl-6- methylindene in methanol, 240 g of a component dispersion of a solution of 15 g of cyan coupler of the following formula:

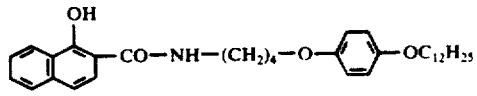

in 7.5 g of dibutylphthalate and
30 g of diethylacarbonate, 100 ml of a 4% aqueous gelatine solution,
0.8 g of Mersolat (R) (wetting agent, sulphonated parwaffin hydrocarbons),
10 ml of a 10% aqueous saponin solution and
1000 ml of water.

d. The composition of the casting solution for the green-sensitive layer is similar to that of the red-sensitive layer (*b*) except that the emulsion is sensitised to the green region of the spectrum and instead of the cyan coupler dispersion it contains 150 g of a dispersion of a magenta coupler of the following formula:

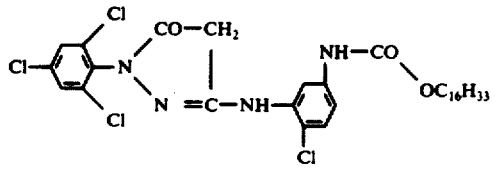

in the composition analogous to the cyan emulsion in layer (*b*).

g. The composition of the casting solution for the blue-sensitive layer is similar to that of the red-sensitive layer (*b*) except that the emulsion is sensitised only to the blue region of the spectrum and instead of the cyan coupler dispersion it contains 175 g of a 5% solution of a yellow coupler of the following formula:

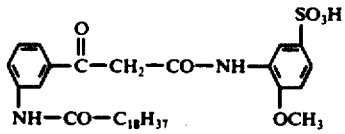

in an aqueous 8% gelatine solution.

The gelatine layers (*a*), (*c*), (*e*) and (*h*) are prepared by casting the following solution:

125 ml of a 10% gelatine solution,
500 ml of water, and
5 ml of a 10% aqueous solution of saponin.

The casting solution for the yellow filter layer is identical to the casting solution for the gelatine layers (*a*), (*c*), (*e*) and (*h*) except that in addition it contains 1.4 g of finely dispersed metallic sliver of the kind commonly used as a barrier filter for the blue spectral portion of light.

PROCESSING

The material is exposed to blue, green or red light behind colour separation filters in a conventional sensitometer behind a grey step wedge and the exposed material is developed in a colour developer of the following composition:

2 g of the sodium salt of isopropanol diaminotetracetic acid,
30 g of potash,
4 g of potassium sulphite,
1.5 g of KBr,
2 g of hyroxylamine, and
5 of a colour developer of the following formula:

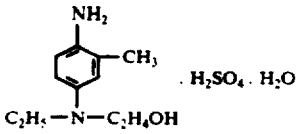

made up to 1 liter. The pH is adjusted to 10.2 Development: 5 minutes at 25° C.

The subsequent processing steps described below each take 8 minutes. The bath temperature in each case is again 25° C.

Short stop bath: 30 ml of acetic acid (concentrated), 20 g of sodium acetate, water up to 1 liter.

Washing

Bleaching bath: 100 g of potassium ferricyanide, 15 g of potassium bromide, water up to 1 liter.

Washing

Fixing bath: 20% aqueous solution of sodium thiosulphate Final washing.

EXAMPLE 1

Incorporation of DIR compound 1 in red sensitive layer (b)

DIR compound 1 is dispersed as follows:

A solution of 4.9 g of compound No. 1 in 3 g of tricresyl phosphate and 12 ml of ethyl acetate is emulsified in a solution of 100 ml of a 4% aqueous gelatine solution and 0.8 g of Merosolat (R) (wetting agent: sulphonated paraffin hydrocarbons) with vigorous stirring in a mixing stren. Arrangement of layers: consisting of layers (*a*), (*b*) and (*c*).

Sample 1: No DIR compound in layer (*b*).

Sample 2: Layer (*b*) contains DIR compound 1.

The casting solution contains 30 g of the dispersion of DIR compound 1 to 1 kg of emulsion.

The samples were exposed to red light behind a step wedge and developed as described above. The inhibitory action of the DIR compound reduces the gradation from $\gamma = 1.40$ (Sample 1) to $\gamma$ 32 0.6 (Sample 2). If in the comparison sample without DIR compound (Sample 1a) quantities of silver halide and of colour coupler are reduced so that a gradation of $\gamma$ 32 0.6 is again obtained, then the graininess of sample 2 which contains the DIR compound is substantially lower than that of sample 1 a in spite of the fact that both samples have the same gradation and substantially the same sensitivity, as shown in the Table below:

| | Sample 1 a | Sample 2 |
|---|---|---|
| Graininess $\delta D.10^{-2}$ at density D = 1 | 2.1 | 1.1 |

The graininess is given in $\sigma$ D-values (r.m.s. values using a measuring aperture with a diameter of 29$\gamma$) and determined by the method described by H.T. Buschmann in "Bestimmung der Kornigkeit photographischer Schichten mit Hilfe digitaler Technik" in Optik 38, 1973, pages 169 - 219.

EXAMPLE 2

Incorporation of DIR compound 2 in intermediate gelatine layer (c).

DIR compound 2 is emulsified as described in Example 1.

A complete layer set (layers *a* to *h*) is prepared in which DIR compound 2 is incorporated in the intermediate gelatine layer (*c*) between the red-sensitive and the greensensitive layer (Sample 1). The casting solution for the modified gelatine layer (*c*) has the following composition:

50 ml of 10% gelatine solution,
33 g of emulsion of DIR compound 2,
500 g of water, and 7 ml of a 10% aqueous solution of saponin.

Layer (*c*) is applied in a thickness of 1.5 μ.

For comparison, a complete layer set containing an unmodified intermediate gelatine layer (*c*) is prepared (Sample 2):

The samples were exposed red, green and white light behind a step wedge and processed as already described above.

The results indicate that the presence of the DIR compound at the time of exposure to red light, that is to say when developing the cyan layer (*b*), completely prevents concomitant development of the magenta layer (*d*), which occurs to some extent in sample 2. In the same way, the presence of the DIR compound in the intermediate layer (*c*) completely prevents development of the cyan layer (*b*) after exposure of the layer to green light, i.e. when developing the purple layer (*d*). The DIR compound absorbs the developer oxidation product diffusing from the adjacent layers by entering into a coupling reaction with it. This reaction releases an inhibitor which diffuses into the adjacent red-sensitive and green-sensitive layers where it inhibits development. An inter-image effect (IIE) is thereby produced which may be defined as follows:

$$IIE = \frac{\gamma_s - \gamma_w}{0.6} \cdot 100\%$$

where $s$ = selective exposure and $w$ = white exposure.

Since the layer sets used in these experiments are not masked, the side densities of the dyes interfere with the determination of the true IIE value. To eliminate this interference of the side densities, gradation curves are drawn up from the analytical densities determined by conversion of the measured integral densities. The γ-values were obtained from these gradation curves.

| | IIE | | Red exposure | Green exposure | White exposure | |
|---|---|---|---|---|---|---|
| | cyan | magenta | cyan $\gamma_x$ | magenta $\gamma_s$ | cyan $\gamma_w$ | magenta $\gamma_w$ |
| Sample 1 | 75 | 48 | 1.00 | 0.85 | 0.55 | 0.56 |
| Sample 2 | 28 | 17 | 1.30 | 1.25 | 1.13 | 1.15 |

The Table clearly shows that the DIR compound incorporated in the intermediate gelatine layer (*c*) considerably increases the IIE value both in the cyan layer and in the magenta layer.

EXAMPLE 3

Incorporation of the DIR compound in the magenta layer (*d*) of total layer sets (layers *a* to *h*):

DIR compounds 3 and, for comparison, prior art compounds A and B (from German Offenlegungsschrift No. 2,405,442) are emulsified in comparable molar quantities as described in Example 1. Comparable molar quantities of emulsions or solutions of the DIR compound are added to the casting solution for layer (*d*) (e.g. in sample 1, 50 g of a dispersion of DIR compound No. 3 to 1 kg of silver halide emulsion).

The samples were exposed to red, green or white light behind a step wedge and developed as described above. Since the film is not masked, the analytical densities are used for drawing up the gradation curves.

The activity of the DIR compounds can be recognised from the magneta γ values obtained from green exposure (pp-$\gamma_s$). The effect of the DIR compound contained in the magneta layer on the IIE of the cyan layer was also investigated.

| | | | Exposure | | |
|---|---|---|---|---|---|
| Sample | DIR compound | IIE Cyan | Red Cyan $\gamma_s$ | Green magenta $\gamma_s$ | White Cyan $\gamma_w$ |
| 1 | 3 | 115% | 1.40 | 0.45 | 0.75 |
| 2 | A | 45% | 1.41 | 1.00 | 1.14 |
| 3 | B | 31% | 1.39 | 1.10 | 1.20 |
| 4 | — | 25% | 1.35 | 1.27 | 1.20 |

Compound A

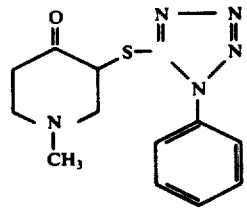

Compound B

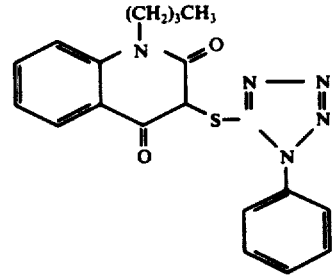

4-Hydroxy-1-butyl-3(1-phenyl-5-tetrazolylthio)-carboxtyril.

It is clear from the Table (pp$\gamma_s$) that the DIR compound 3 (Sample 1) is most active, i.e. has the most powerful inhibitory effect, in the magentalyer in which it is incorporated. The other DIR compounds are much less active. On exposure to white light, the inhibitor which is released from the DIR compound No. 3in the magenta layer by development and diffuses into the cyan layer also vigorously inhibits development of the cyan layer so that a powerful cyan IIE (115%) is obtained. The IIE in the adjacent cyan layer, which already exists even without DIR coupler (Sample 4), is much less increased by the other DIR compounds.

Analogous results are obtained when the other compounds 1 - 13 are used instead of compound 3.

We claim:

1. A light-sensitive color photographic material with at least one silver halide emulsion layer, containing at least one dye image producing compound and containing a development inhibitor releasing homophthalimide thioether compound capable of reacting with the oxidation product of an aromatic primary amino silver halide developing agent to form a releasable mercaptan capable of inhibiting photographic development the said homophthalimide thioether compounds are substituted with the sulfur of the thioether group in the 4-position and the nitrogen atom of the imido group in the 2-position of the homophthalimide is a tertiary nitrogen atom substituted with an alkyl, aryl, heterocyclic or an acylamino group.

2. The material of claim 1, wherein the homophthalimide thioether compound has the following formula

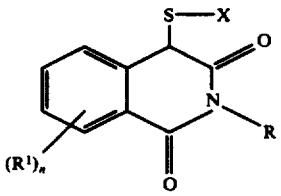

wherein

X represents an aliphatic, aromatic or hetercyclic group

R stands for an alkyl, aryl, heterocyclic or an acylamino group, $R^1$ represents hydrogen, alkyl or alkoxy having up to 5 carbon atoms, sulfamyl, nitro, amine, acylamine or halogen and

*n* stands for an integer of between 1 and 3.

3. The material of claim 2 wherein R is a diffusion resistant rendering group.

4. The material of claim 3 wherein R is a long chained or branched aliphatic group of between 8 and 20 carbon atoms or a phenyl group containing at least one aliphatic group of 1 to 20 carbon atoms.

5. The material of claim 2 wherein X is a heterocyclic ring selected from the groups consisting of tetrazolyl, triazolyl, thiadiazolyl, thiazolyl, pyrimidyl or triazinyl.

6. The material of claim 5 wherein X is a 1-phenyltetrazolyl group.

* * * * *